US009644647B2

(12) United States Patent
Wadeson et al.

(10) Patent No.: US 9,644,647 B2
(45) Date of Patent: May 9, 2017

(54) HIGH PRESSURE HYDRAULIC CONTAMINATION INJECTION AND CONTROL SYSTEM

(71) Applicant: Kepstrum Inc., Vaughan (CA)

(72) Inventors: Graham Wadeson, Vaughan (CA); Payman Kianpour, Vaughan (CA); Amir Fazeli, Vaughan (CA)

( * ) Notice: Subject to any disclaimer, the term of this patent is extended or adjusted under 35 U.S.C. 154(b) by 332 days.

(21) Appl. No.: 14/195,977

(22) Filed: Mar. 4, 2014

(65) Prior Publication Data

US 2014/0326086 A1 Nov. 6, 2014

Related U.S. Application Data

(60) Provisional application No. 61/817,900, filed on May 1, 2013.

(51) Int. Cl.

| | |
|---|---|
| ***B01F 15/02*** | (2006.01) |
| ***B01F 15/04*** | (2006.01) |
| ***F15B 19/00*** | (2006.01) |
| *F15B 21/04* | (2006.01) |

(52) U.S. Cl.

CPC ..... *F15B 19/007* (2013.01); *B01F 15/026* (2013.01); *B01F 15/0235* (2013.01); *B01F 15/0483* (2013.01); *F15B 19/005* (2013.01); *F15B 21/041* (2013.01)

(58) Field of Classification Search

CPC ..... B01F 15/00954; B01F 15/0216; B01F 15/0235; B01F 15/026; B01F 15/0261; B01F 15/0441; B01F 15/0483; F15B 19/005; F15B 21/041

See application file for complete search history.

(56) References Cited

U.S. PATENT DOCUMENTS

| | | | | |
|---|---|---|---|---|
| 4,335,964 | A * | 6/1982 | Drake | B01F 15/0201 222/239 |
| 6,050,130 | A | 4/2000 | Kramer | |
| 6,994,464 | B2 * | 2/2006 | Villwock | B01D 19/0052 366/136 |
| 2003/0213292 | A1 | 11/2003 | Budeiri et al. | |
| 2004/0042335 | A1 * | 3/2004 | Cecala | A01C 23/042 366/151.1 |
| 2011/0232547 | A1 | 9/2011 | Schmit et al. | |
| 2014/0326086 | A1 * | 11/2014 | Wadeson | F15B 19/007 73/865.6 |

FOREIGN PATENT DOCUMENTS

| | | | | |
|---|---|---|---|---|
| DE | 19911119 | A1 * | 9/2000 | B01D 47/06 |
| WO | WO 03086604 | A1 * | 10/2003 | B01D 19/0052 |
| WO | WO 2012099508 | A1 * | 7/2012 | A23G 3/0006 |

* cited by examiner

*Primary Examiner* — Charles Cooley

(74) *Attorney, Agent, or Firm* — Nasser Asheriz; UIPatent Inc.

(57) ABSTRACT

An automated particulate contaminant injection and control module that controls the level of contamination in the hydraulic fluid passing to a component, system or sub-system under test and removes the injected particulates upon return to the parent test stand. Using the pressure and flow of clean hydraulic fluid from the parent test stand, the contamination module prepares a concentrated contaminant slurry and injects it at a rate determined by a feedback signal from an in-line contamination sensor and an internal control algorithm.

7 Claims, 6 Drawing Sheets

(a)

(b)

HIGH PRESSURE HYDRAULIC CONTAMINATION INJECTION AND CONTROL SYSTEM

RELATED APPLICATIONS

This application claims the benefit under 35 U.S.C. 119(e) of U.S. Provisional Patent Application Ser. No. 61/817,900 filed on May 1, 2013, which is incorporated herein by reference in its entirety and made a part hereof.

FIELD OF THE INVENTION

The present invention is a Life-Generator for the generation of contamination stress-life models. This is embodied in an electrically and electronically controlled hydraulic device for addition of known concentrations of particulate matter into a hydraulic test circuit and for its subsequent removal upon return of the fluid from the component under test.

DESCRIPTION OF THE RELATED ART

A major cause of failure in hydraulic components is the seizing of moving parts or wear in sliding or impingement points as a result of particulate matter in the fluid. To date design engineers have relied upon: (a) low pressure exposure to contamination in simulated test rigs; (b) uncontrolled build-up of natural wear products over an extended operating period; or (c) the addition of known amounts of particulate matter to the main test circuit.

In low pressure systems, stresses on the component are low and particulate related failures either do not occur or do not replicate the failure mechanisms seen at full operating pressure. Allowing contaminants to build up naturally in a system provide conditions that are closer to reality but require an extremely long time under test and are totally indeterministic. This is due to the particulates being of unknown material, hardness, morphology and size distribution, and well as being related to the test circuit rather than the application. The separate addition of particulate material of known quantity and specification allows for accelerated testing but does not allow for the break-down or agglomeration of particulates in the circuit. This exposes potentially very valuable test system components, such as high-pressure pumps and servo-valves, to damaging levels of contamination. Consequently, companies have ignored contamination testing of new products, relying rather on field data to provide expected life based upon inaccurate assumptions of expected contamination levels. This exposes companies to high levels of risk associated with early failure of their products or operators to the increased cost of running unnecessarily clean systems.

It is an object of the present invention to provide companies with a deterministic means of generating contamination life models, allowing them to predict the expected life in the application and to set reasonable cleanliness standards for the operator.

SUMMARY OF THE INVENTION

In one of its aspects, a contaminant powder conditioning unit is provided in which the selected contaminant is prepared for batching into the pre-mixing vessel, comprising:

- A holding hopper with sufficient capacity to supply contaminant powder to the injection unit for at least 24 hours operation at a maximum injection rate;

- A conditioning stirrer with multiple fingers oriented to maintain a consistent contaminant powder bulk density and ensure reliable discharge into the batching valve; and
- A geared motor unit rotating the conditioning stirrer at a set speed to provide powder conditioning without excessive aeration or damage to the contaminant particles.

In another of its aspects, a contaminant powder batching unit is provided in which a predetermined quantity of contaminant powder is discharged into a pre-mixing vessel, comprising:

- A pneumatic slide plate valve, moving backward and forward in a reciprocating motion at a predetermined frequency to transfer contaminant powder from the conditioning hopper outlet to the pre-mixing vessel inlet port, transfer being achieved by filling and discharging a recess of known volume, determined from the required concentration of contaminated fluid in the pre-mixing vessel and the conditioned bulk density of the contaminant powder;
- A pneumatically actuated plunger, synchronized with the slide plate valve, which ensures complete discharge of the powder from the recess into the pre-mixing vessel; and
- A rear relief port into the pre-mixing tank to prevent valve jamming due to carry-over beyond the end of the plate, while avoiding powder escapes into the working environment.

In another of its aspects, a pre-mixing and feeding system is provided for the preparation and delivery of contaminated fluid concentrates in slurry form to the injection unit, comprising:

- A pre-mixing vessel, containing ports for input of powder from the batching unit and overspill from the rear of the slide plate; a fluid filling port and dip tube for refilling the vessel as required without excessive aeration of the fluid; a variable speed mixer to achieve even dispersion of the contaminant powder without aeration of the fluid;
- A feed vessel and actuated inlet valve for rapid transfer of the contaminated fluid concentrate from the pre-mixing vessel; an inlet dip tube to prevent aeration of the fluid during transfer; an air balance tube connecting the feed and pre-mixing vessels; a variable speed mixer and impeller for maintenance of contaminant dispersion within the feed vessel; and
- A control system, comprising hardware and software, that monitors the levels of the pre-mixing and feed vessels and initiates replenishment of the feed vessel and preparation of new batches of contaminant slurry of the required concentration.

In another of its aspects, a contamination injection system is provided that injects the contaminated fluid concentrate into the clean oil stream entering the hydraulic test circuit, comprising:

- A high pressure variable speed hydraulic injector that provides contaminant slurry injection into the main flow at the rate determined by the injector control system;
- An injector drive system, which may be hydraulic, mechanical or electrical in nature, that generates the hydraulic pressure required for slurry injection into the main flow;

A system of valves and pipework that ensures even and consistent forward flow from the concentrate slurry feed tank to the main flow and on into the device under test; and A control system, comprising hardware and software components, that adjusts the injector drive and the rate of injection to achieve the targeted contamination level in the fluid flow to the device under test based on a representative contaminant sensor feedback signal generated downstream of the injection point.

In another of its aspects there is provided a contamination sensing system that generates feedback control to the injector and monitors the clean oil supply quality. The sensing system is configured to ensure representative sampling of the tested stream, accurate control of the sample flow rate under different pressure and temperature conditions and to avoid sensor errors caused by entrained air bubbles in the sample.

In another of its aspects there is provided a multi-stage filtration system that removes contaminant particles from the fluid stream returning from the device under test so that, in a single pass, fluid contamination falls to a level compatible with downstream components of the test circuit (e.g. high pressure pumps, close tolerance valves, etc.).

The control system of the Life Generator, encompassing the concentrate slurry make-up, transfer and injection systems described above, provides the operator with the option for open loop injection control or pre-set closed loop control of contamination levels and is fitted with all necessary safety features and alarms.

BRIEF DESCRIPTION OF THE DRAWINGS

Several drawings of the present invention are described below with reference to the appended drawings in which:

FIG. 3 (*b*) shows the powder conditioning paddle;

FIG. 3 (*c*) shows the powder conditioning paddle;

FIG. 4 (*b*) shows the powder discharge plunger mechanism;

DETAILED DESCRIPTION OF EXEMPLARY EMBODIMENTS

This detailed description of the embodiments of the present invention refers to the accompanying diagrams by way of illustration of the embodiment in its best mode. While the invention is described in sufficient detail for those skilled in the art to practice the invention, certain essential connecting parts and components necessary for the invention to operate in the desired manner have been omitted where such items may be construed as general engineering constructs that may be left to the discretion of the engineer in his/her implementation of the invention (e.g. general pipework arrangement, transfer valve, support structure, compressed air pipework).

Figure 1:
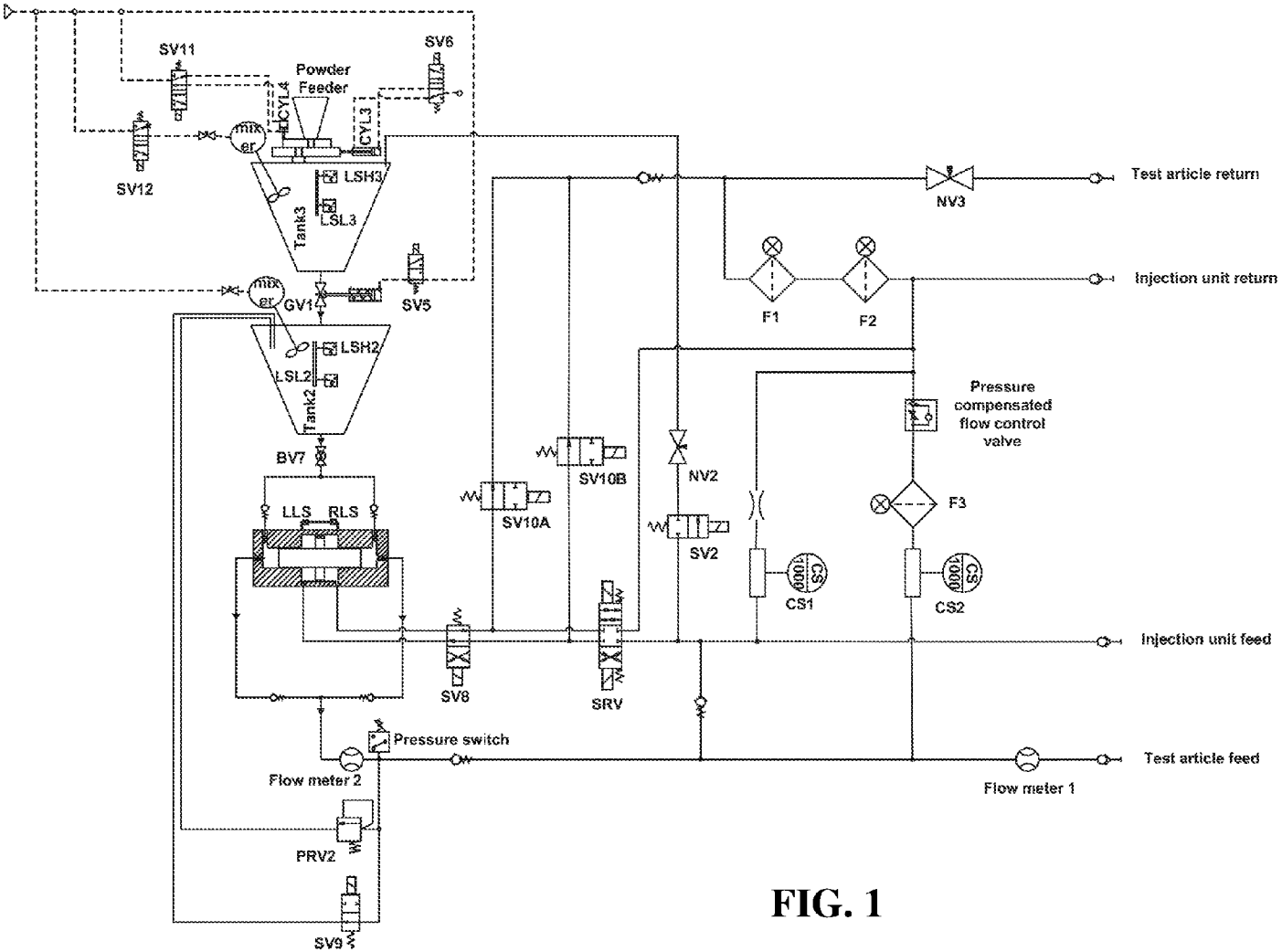
FIG. 1 shows a schematic diagram of the hydraulic injection and driver circuits.

FIG. 1 shows the hydraulic schematic for the present invention, displaying the circuits for: contaminated fluid concentrate make-up, transfer and injection; the main, clean oil supply and injection driving circuits; and the controlled contaminated oil circuit through the device under test and back through the filtration system. FIG. 1 also shows the contamination measurement, safety pressure relief and unloading circuits.

Figure 2:
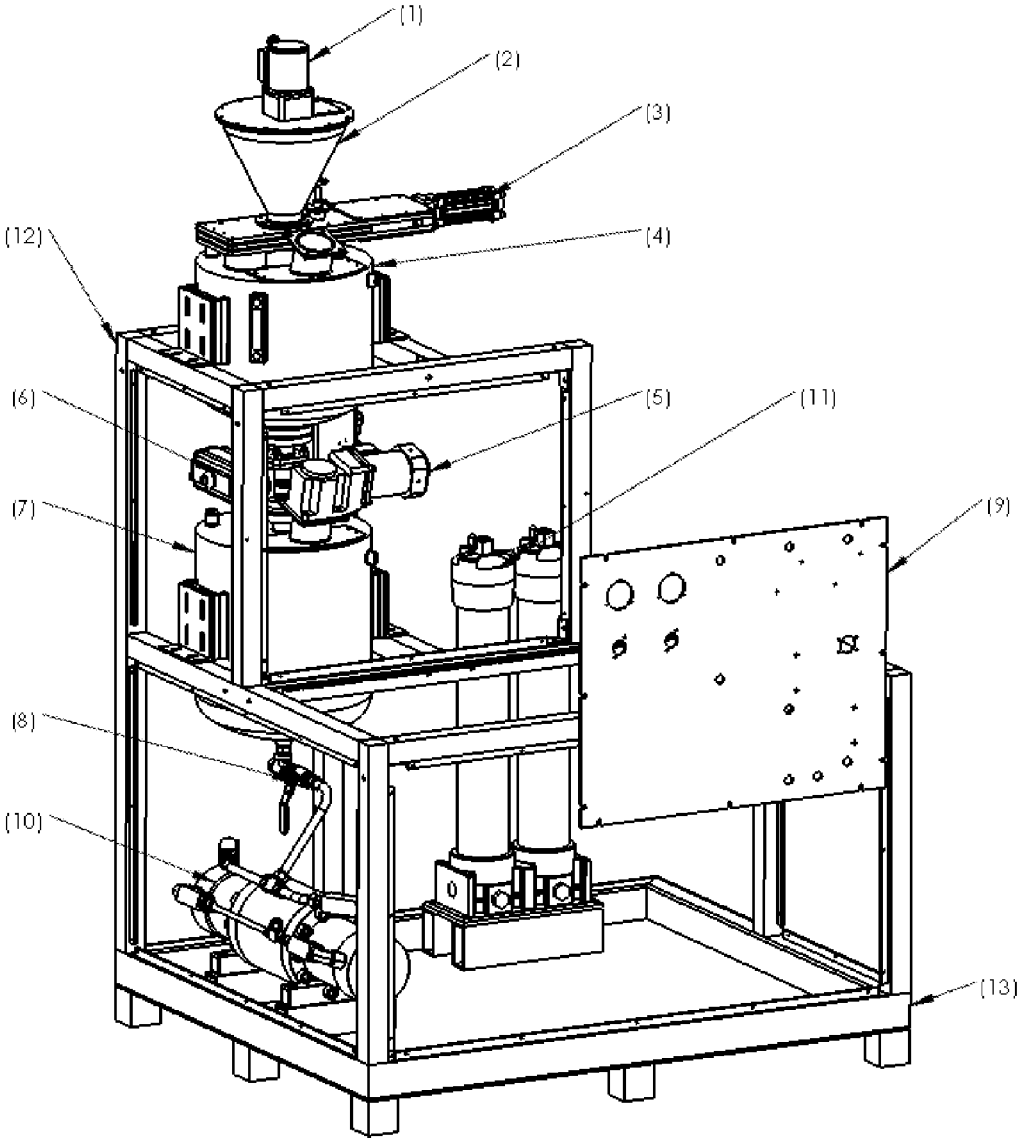
FIG. 2 shows the general arrangement of the contamination life generator.

FIG. 2 shows the physical arrangement of the system. Pre-graded particulate contaminants are loaded into the powder feed hopper (2) in which a geared motor drive (1) drives conditioning paddles at between 0 and 120 rpm in order to ensure consistent powder bulk density and mobility for the duration of the test. In response to level sensors in the feed vessel (7) and pre-mixing vessel (4), particulate contaminant material is discharged from the powder hopper into the pre-mixing vessel through the slide plate batching valve (3) in quantities of 2 to 6 g, depending upon the concentration level required. An air-driven mixer in the pre-mixing vessel (4) continuously stirs the fluid, except during filling, to ensure good particulate dispersion is achieved and maintained for the duration of the test program. A low shear agitator (5) installed on the feed vessel (7) to maintain an even distribution of contaminant particles in the feed tank (7). The same low shear agitator can be used in the pre-mixing vessel (4) (not shown is the figure) which is used to break up any agglomerates in the powder as it is batched into the tank. Both of these agitators are important to achieving a consistent contaminant injection concentration. When the level of contaminated fluid in the feed vessel (7) has fallen as a result of injection, to reach the low level sensor, an air actuated transfer valve (6) opens for sufficient time to ensure complete discharge of the pre-mixing tank's contents into the feed tank, thus avoiding variations in contaminant concentration that would occur in a single tank system. The premixing (4) and feed vessel (7) are mounted vertically above one another in support frame (12-13) to allow rapid gravity transfer of the contaminated fluid concentrate between the tanks. A manual valve (8) at the outlet from the feed vessel provides isolation from the injector. From this valve the flow is divided to supply each end of the contaminant injector (10) through a non-return check valve. This check valve is designed to supply a constant flow of fluid to the injector at low pressure drop, thus avoiding cavitation and variations in its volumetric efficiency. A set of driving, mixing and injection valves and pipework (9) provides the means for operating the injector and for injecting a known quantity of contaminant concentrate into the clean oil entering the contamination module from the parent test stand. Contaminated fluid returning from the device under test is passed through a pair of filters (11) in series to remove up to 99% of the particulates.

Figure 3:
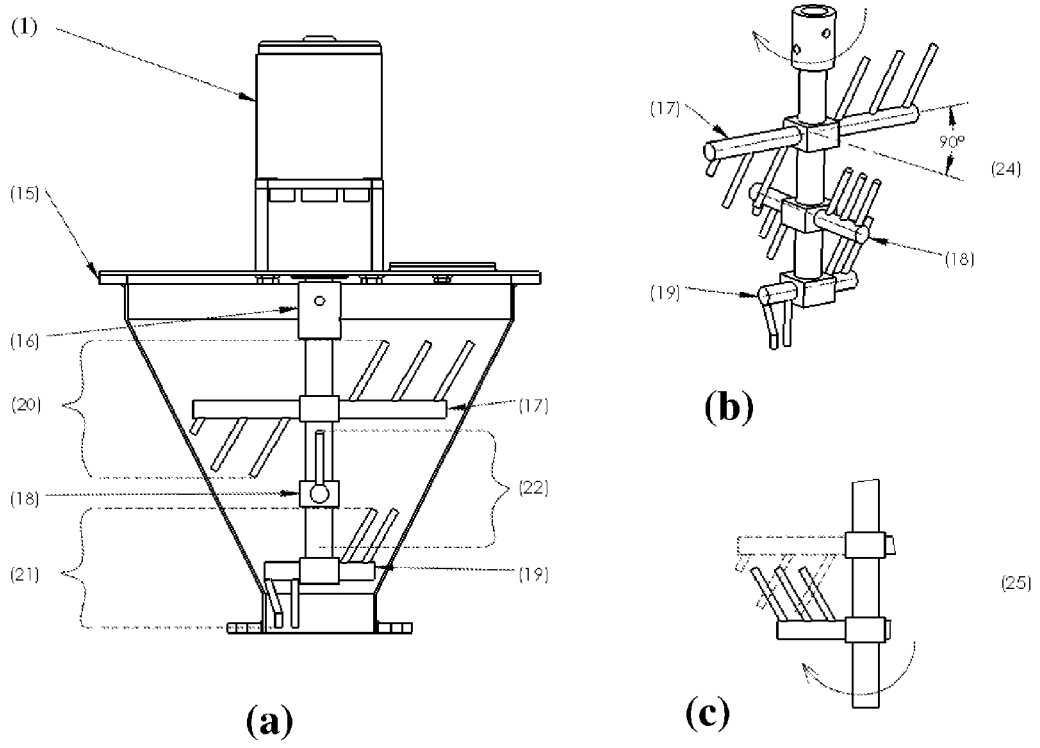
FIG. 3 (*a*) shows the powder hopper and the powder conditioning paddle.

FIG. 3 shows a cross section through the powder hopper (2) and the conditioning paddles. The drive motor and gearbox (1) drives through a rigid coupling (15-16) to turn the paddle shaft. The paddle shaft carries 3 or more rotating arms (17, 18, 19), each of which is fitted with a series of conditioning fingers pointing diagonally upwards or downwards from the arm. Fingers are arranged so that fingers on arms mounted to the same hub point in opposite directions. Adjacent hubs along the length of the paddle shaft are oriented at 90° to one another (24). Hubs are positioned sufficiently close together along the shaft to ensure the fingers significantly overlap along the vertical axis (20, 21, 22). This arrangement results in a criss-cross stirring action (25) for each rotation of the shaft and avoids the possibility of bridging across the body of the powder hopper. Conditioning fingers also protrude down through the powder material to a point just above the slide-plate valve, ensuring that the transfer amount is consistent.

Figure 4:
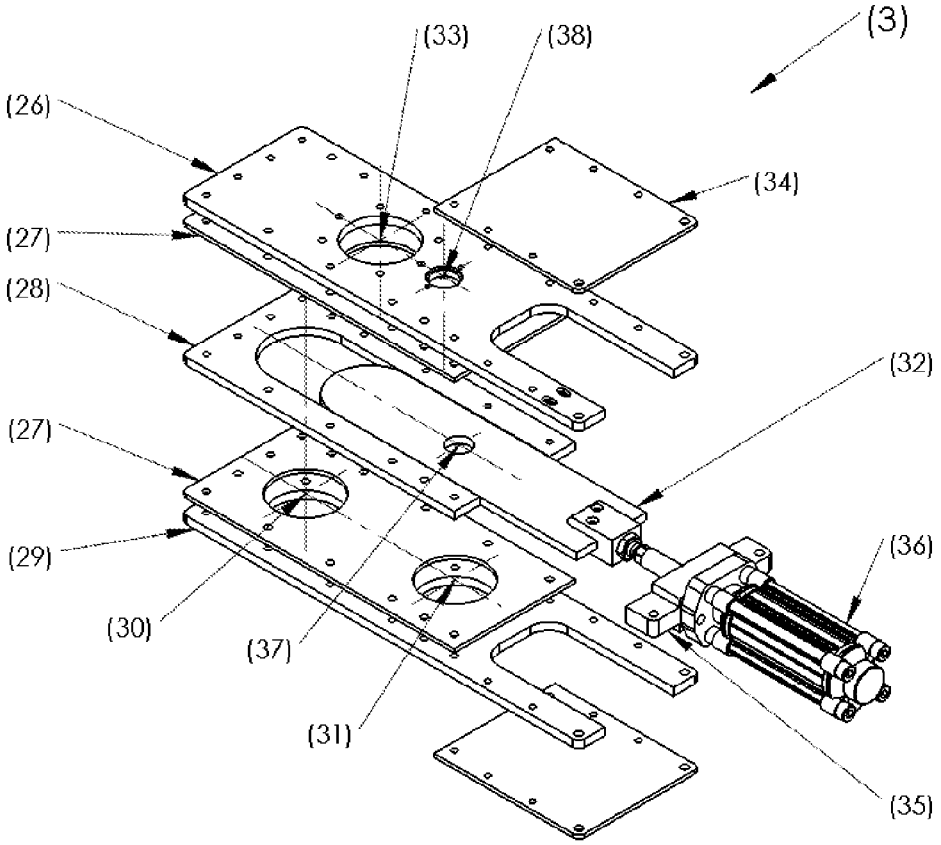
FIG. 4 (*a*) shows the slide plate contamination powder batching valve arrangement.
Figure 4:
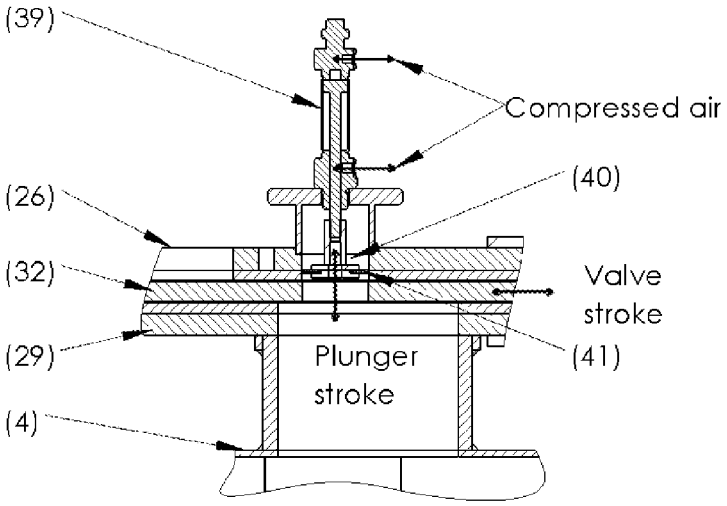

FIG. 4 (*a*) shows an exploded view of the slide plate valve (3). The top plate (26) and discharge plate (29) of the valve connect the slide plate valve (3) from top and bottom to the powder feed hopper (2) and pre-mixing vessel (4). The top plate (26) carries the powder hopper aligned with the fill hole (33). When the compressed air cylinder (36) is extended it pushes the slide plate (32) forward such that the batching recess (37) is fully encompassed by the fill hole (33) and powder hopper outlet. The slide plate (32) moves within a spacer plate (28) and top and bottom bearing plates (27) made from low friction material. When a batch of powder is called for by the control system, the compressed air cylinder (36) retracts and, supported by the cylinder support cross beam (35) and cylinder support bars (34), moves the slide plate (32) so that the batching recess (37), and the powder contained within it, is fully encompassed by the discharge hole (30-31) in the discharge plate (29). At this position the contaminant powder falls through the discharge hole (30-31) into the pre-mixing vessel (4). Simultaneously, a small compressed air cylinder (39)—see FIG. 4 (*b*)—drives a plunger through the slide plate to assist in discharging powder plug (41) from the batching recess (37) with helps of ejector brush (40) which ensures complete discharge of the powder from the dosing valve and consistency of injector feed concentration. The end of the plunger is fitted with a circular wire brush to ensure all of the contaminant powder is removed from the sides of the batching recess and a consistent contaminant concentrate slurry is produced.

Figure 5:
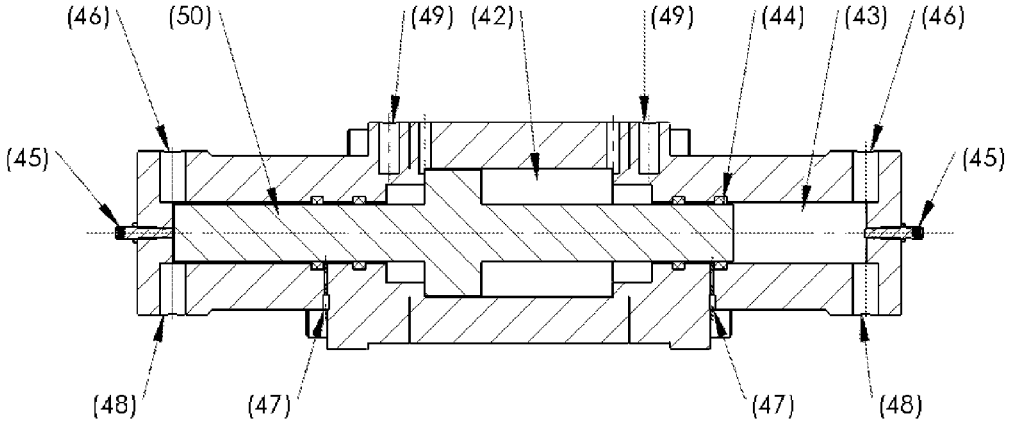
FIG. 5 shows the high pressure injector.

FIG. 5 shows a cross-section through the high pressure variable speed hydraulic injector used to inject contaminated concentrate slurry into the fluid stream to the device under test. The injector (10) comprises a driving cylinder (42) and piston with injection rods connected to each side of the piston (50). The injection rods (50) each act within an injection cylinder (43) connected to each end of the driving cylinder (42). High pressure clean fluid is applied in turn to the ports (49) at each end of the driving cylinder, moving the piston back and forth, switch over occurring upon actuation of the proximity switches (45) located at the end of each injection cylinder with the approach of the injection rod. Depending upon the direction of travel of each injection rod, the injection cylinder may be filling from the feed vessel (7) through the inlet port (46) or injecting at high pressure through the discharge port (48). While the driving piston has a travelling seal arrangement designed for bi-directional sealing, the rod seals (44) in the injection cylinders are static and are optimized to provide dirty fluid sealing from the injection cylinder side and clean oil sealing from the driver cylinder. Leakage drain ports (47) positioned between the injection cylinder seals provide a visible indication of seal failure.

Figure 6:
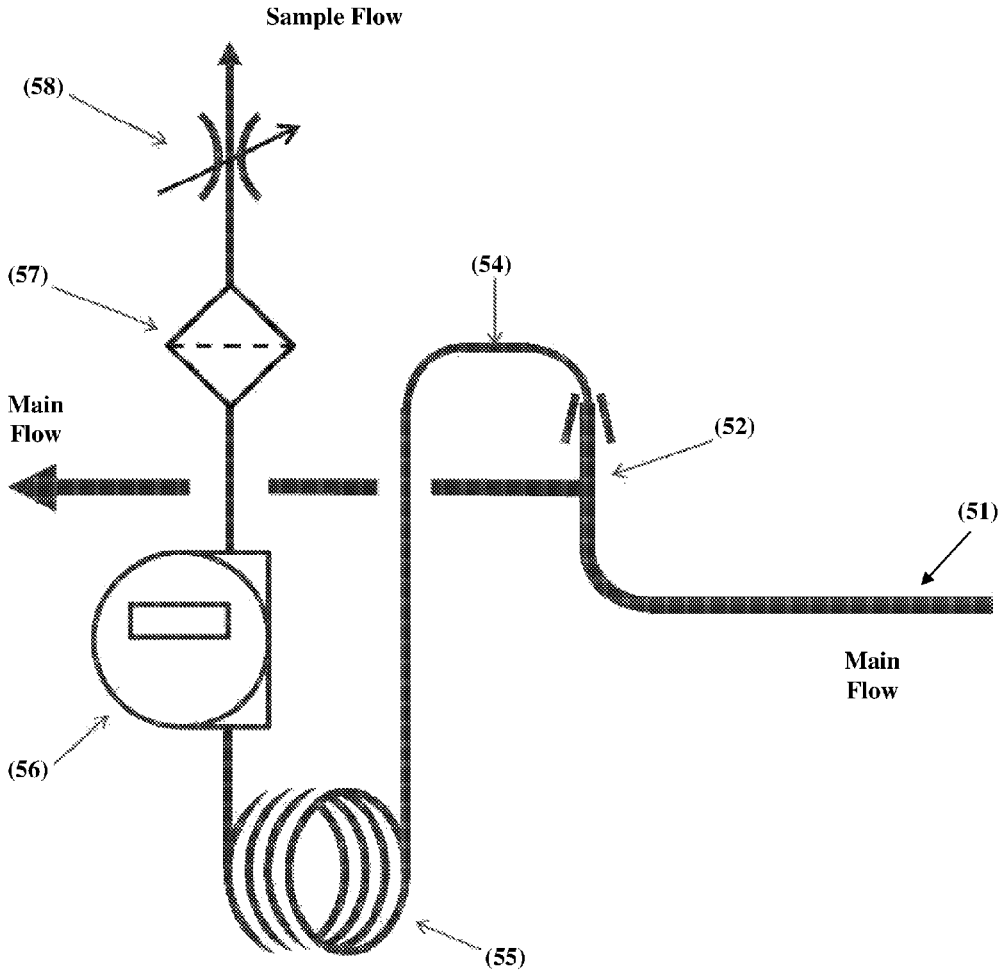
FIG. 6 shows an exemplary arrangement of the contamination sensors.

FIG. 6 shows an exemplary arrangement of the contamination sensor. The main flow (51) to be measured is turned through an elbow or a bend before exiting through the branch of a T point (sampling point) (52). This provides a high degree of turbulence at the T point (sampling point) (52). The sample pipe (54) is a reduced diameter such that the flow is within the required range of the sensor and the flow velocity greater than 1 m/s to avoid sedimentation within the line. The sample line, which may be in the form of hard pipe or hose, forms a coil (55) upstream of the contamination sensor (56) of at least 3 m path length. The flow rate through the sensor is controlled by a pressure and temperature compensated flow control valve (58). A high pressure depth filter (57), having a maximum nominal size rating of 3 microns, is placed between the sensor (56) and the flow control valve (58) to prevent valve damage from high particulate concentrations.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A high pressure hydraulic contamination injection device for adding of a contamination powder into a clean fluid to produce a contaminated fluid for a hydraulic test and removing said contamination powder from said contaminated fluid after said hydraulic test comprising:

a. a powder feed hopper to keep said contamination powder;

b. a geared motor drive to drive a plurality of conditioning paddles installed inside of said powder feed hopper to ensure consistent powder bulk density and mobility for the duration of said hydraulic test;

c. a slide plate batching valve to discharge a predetermined quantity of said contamination powder from said powder feed hopper to a pre-mixing vessel containing a predetermined quantity of said clean fluid;

d. said pre-mixing vessel being equipped with an air-driven mixer to mix said clean fluid with said contamination powder to produce a contaminated fluid and to ensure good particulate dispersion is achieved and maintained for the duration of said hydraulic test;

e. an air actuated transfer valve transfers said contaminated fluid to a feed vessel;

f. said feed vessel being equipped with a low shear agitator to maintain an even distribution of said contamination powder in said contaminated fluid;

g. a plurality of level sensors to monitor the level of said contaminated fluid in said feed vessel and command to said air actuated transfer valve to open when the level of said contaminated fluid in said feed vessel is low;

h. a manual valve at a distal end of said feed vessel to provide isolation from a contaminant injector;

i. said contaminant injector injects a predetermined quantity of said contaminated fluid into a clean fluid flow entering to a into contamination module from a parent test stand;

j. a plurality of filters to remove said contamination powder from said contaminated fluid returning after the hydraulic test from said parent test stand; and k. a support frame having a right and a left longitudinally extended beams with ground engaging legs to stably support said infection device, wherein the spacing between said right and left beams defines the width of the support frame.

2. The high pressure hydraulic contamination injection device of claim 1, wherein said predetermined quantity of said contamination powder is in the range of 2 grams to 6 grams.

3. The high pressure hydraulic contamination injection device of claim 1, wherein said conditioning paddles comprising:

a.;

b. a paddle shaft longitudinally extended from a proximal end to a distal end of said hopper connected from said proximal end to said geared motor drive; and c. a plurality of rotating arms being fitted with a plurality of conditioning fingers pointing diagonally upwards or downwards from said plurality of rotating arms, wherein said plurality of rotating arms are sized to the width of said hopper.

4. The high pressure hydraulic contamination injection device of claim 3, wherein said plurality of rotating arms along the length of the paddle shaft being oriented at 90° to one another to ensure said conditioning fingers significantly overlap along a vertical axis of said injection device to ensure consistency of bulk density and mobility of said contamination powder.

5. The high pressure hydraulic contamination injection device of claim 1, wherein said slide plate batching valve discharges a batch of said contamination powder to said pre-mixing vessel comprising:

a. two pairs of support bars being connected to said powder feed hopper and said pre-mixing vessel;

b. a top plate to hold said powder feed hopper aligned with a fill hole;

c. a compressed air cylinder to push a slide plate forward within a spacer plate such that a batching recess is fully encompassed by said fill hole;

d. a top and a bottom bearing plate made from low friction material to let said slide plate move within said spacer plate; and e. a plunger equipped attached to said compressed air cylinder through the slide plate assisting in discharging said batch of said contamination powder.

6. The high pressure hydraulic contamination injection device of claim 1, having a control system that monitors level of said pre-mixing and feed vessels and initiates replenishment of said feed vessel and preparation of a new batch of contaminated fluid including the predetermined quantity of said contamination powder.

7. The high pressure hydraulic contamination injection device of claim 1, having an injector drive system to generate hydraulic pressure to inject a contaminated fluid into said hydraulic test, wherein said injection drive system is selected from the group consisting of a hydraulic system, a mechanical system, and an electrical system.

* * * * *